United States Patent [19]

Sparks et al.

[11] 3,973,550

[45] Aug. 10, 1976

[54] ENGINE SHUT-DOWN DEVICE

[75] Inventors: Buddy G. Sparks, Tulsa; Lewis M. Carlton, Jenks, both of Okla.

[73] Assignee: Frank W. Murphy Manufacturer, Inc., Tulsa, Okla.

[22] Filed: Nov. 10, 1975

[21] Appl. No.: 630,619

[52] U.S. Cl. ..... 123/198 DB; 123/139 AZ; 74/529

[51] Int. Cl.[2] ..... F02B 77/00

[58] Field of Search... 123/198 D, 198 DB, 198 DC, 123/139 AZ; 251/294; 74/529

[56] References Cited

UNITED STATES PATENTS

| | | | |
|---|---|---|---|
| 2,248,453 | 7/1941 | Fingai et al. | 123/139 AZ |
| 2,410,998 | 11/1946 | Reavis | 123/198 DC X |
| 2,423,728 | 7/1947 | Ray | 123/198 DC |
| 2,551,429 | 5/1951 | Eppens | 123/198 DB X |
| 2,706,025 | 4/1955 | Halttonen | 123/198 DB |
| 3,419,083 | 12/1968 | Cholin et al. | 251/294 X |
| 3,757,612 | 9/1973 | Schaefer | 251/294 X |
| 3,791,366 | 2/1974 | MacMillan | 123/198 DB |
| 3,885,770 | 5/1975 | Houk | 251/294 |
| 3,926,123 | 12/1975 | Bastenhof | 123/139 AZ |

*Primary Examiner*—Charles J. Myhre
*Assistant Examiner*—Ira S. Lazarus
*Attorney, Agent, or Firm*—D. Paul Weaver

[57] ABSTRACT

A simplified and reliable shut-down device for stationary diesel engines and the like employs a solenoid whose armature is carried directly by a manually operable reset rod having a locking element therein for cooperation with a vibration-proof latch means on the shell or casing of the solenoid. A push-pull cable attached to the reset rod serves to pull the rack or other fuel control member of the engine to immediately shut down the engine responsive to spring force on the reset rod opposing the holding force of the solenoid. The device is electrically fail-safe, as any interruption of electrical power to the solenoid coil will result in immediate engine shut down.

10 Claims, 6 Drawing Figures

ENGINE SHUT-DOWN DEVICE

BACKGROUND OF THE INVENTION

A definite need exists for a more reliable, simplified and more economical mechanism for shutting down diesel engines and the like immediately in the event of a serious engine malfunction. Devices for this purpose are known in the prior art but have not proven to be entirely satisfactory due to excessive complexity and cost, too many parts employed, and instability of the mechanism under heavy vibration. Examples of the patented prior art are shown in U.S. Pat. Nos. 2,096,291; 2,551,429; 2,706,025 and 2,854,964.

The objective of the invention, therefore, is to provide a more simplified and reliable device or mechanism for shutting down engines responsive to an engine malfunction. In accordance with the invention, the device employs a significantly reduced number of parts which are sturdy in construction and simplified as to operation and very reliable. Excessive vibration will not cause premature release of the mechanical latch means nor interfere with the resetting thereof manually. The device employs a manual linear reset rod or plunger which directly carries the armature of a solenoid which is used to hold the mechanism in an engine "on" position against the opposing force of a spring which constantly biases the mechanism to the engine "off" or shut-down position. The simple vibration-proof latch mechanism associated with the reset rod and solenoid allows the device to be installed in any position without dependency on gravity.

Following any interruption of power to the coil of the solenoid, spring force returns the reset rod immediately to the engine shut-down position, thus rendering the device electrically fail-safe.

Other features and advantages of the invention will become apparent during the course of the following description.

DESCRIPTION OF DRAWING FIGURES

DETAILED DESCRIPTION s

Figure 1:
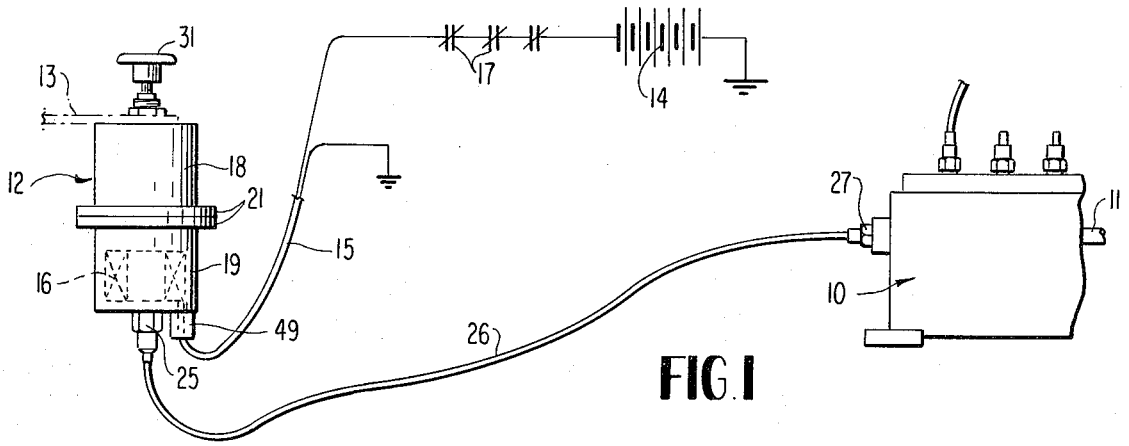
FIG. 1 is a diagrammatic view of the invention shown in relation to a stationary diesel engine and electrical power source.

Referring to the drawings in detail, wherein like numerals designate like parts throughout, the numeral 10 designates a stationary diesel engine, such as an industrial engine, having a rack 11 or like engine fuel control element which requires pulling in one direction in order to shut-down the engine immediately, in the event of an engine malfunction, such as a sudden loss of oil pressure. An engine shut-down device 12 embodying the invention is shown in FIG. 1, fixed to any convenient support element 13. The device 12 is shown upright in the drawings for convenience, and it should be understood that a feature of the invention is that the shut-down device may be mounted in any position, not being dependent on gravity for the proper operation of its mechanical latching means, which means is also substantially uneffected by vibration. FIG. 1 shows the device set or latched in the engine running position. A source of current 14, such as a battery, is connected by a cable 15 to the coil 16 of an electrical solenoid which will be fully described. The cable 15 has connected in it one or more conventional normally closed safety switches 17 which will open following an engine malfunction or removal of a control wire thereby de-energizing the solenoid coil and instantly stopping the engine 10. The device is therefore electrically fail-safe, which is another feature of the invention.

Figure 6:
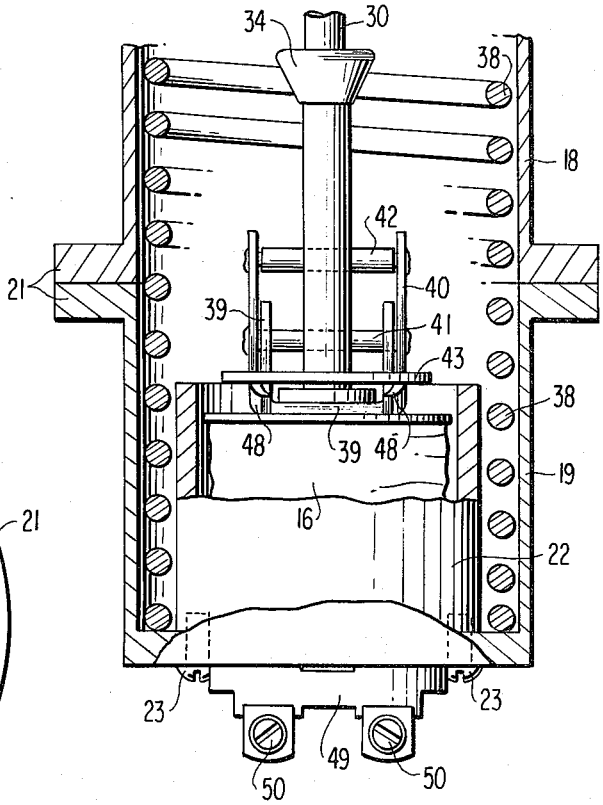
FIG. 6 is a fragmentary vertical section through the device taken at right angles to FIG. 2.

Referring to the other drawing figures, the engine shut-down device or mechanism 12 comprises opposing cylindrical housing sections 18 and 19 which may be joined by screws 20 at their meeting flanges 21. Within one end of the housing thus formed, the casing 22 of an electrical solenoid having the coil 16 is fixedly mounted as by screws 23, FIG. 6. A threaded fitting 24 on the end wall of casing 22 has a coupling 25 attached thereto, said coupling carried by one end of a push-pull cable 26 having its other end coupled as at 27, FIG. 1, to the engine fuel control element or rack 11.

A threaded guide fitting 28 secured in the remote end wall 29 of the housing serves to clamp the device 12 to the aforementioned support element 13 and also serves as an axial guide for a manual control or reset rod 30 having a knob 31 on the end thereof outside of the housing.

Figure 2:
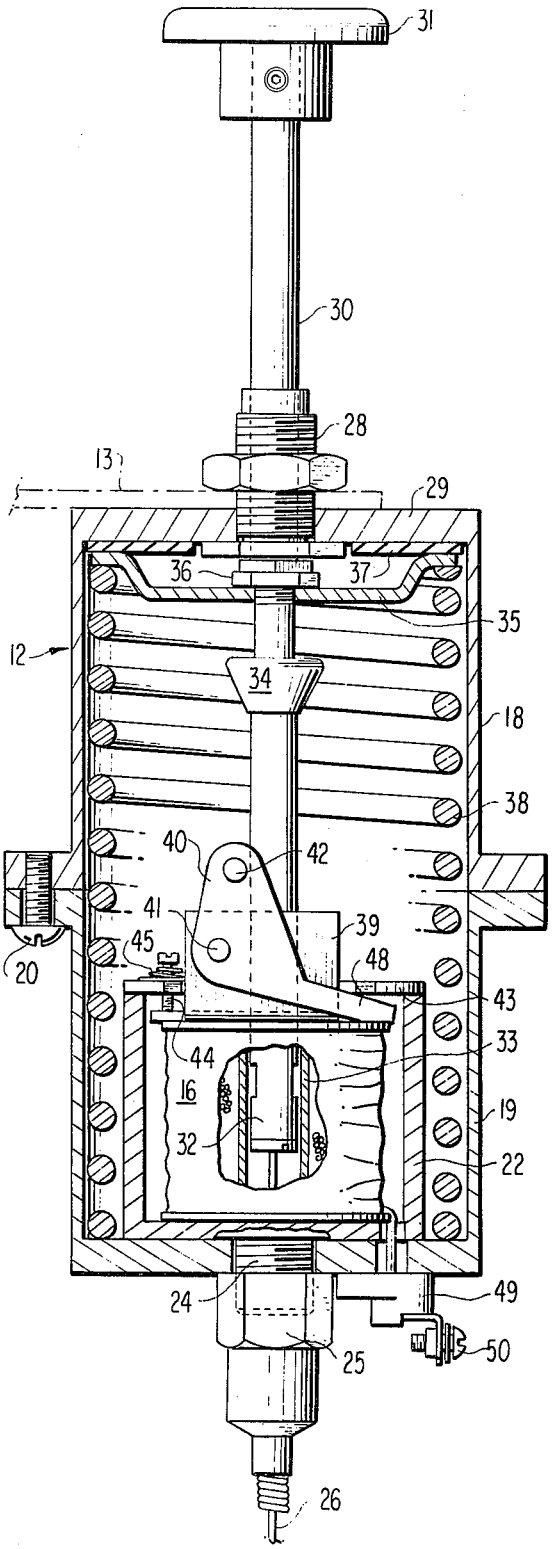
FIG. 2 is an enlarged central vertical longitudinal section through the engine shut-down device embodying the invention with the device in the unlatched or released condition to cause engine shut-down.

The reset rod 30 extends centrally and axially of the housing and the end of the rod remote from the knob 31 and inside of the housing directly carries the movable armature 32 of the solenoid, FIG. 2, which armature is received by an internal guide sleeve 33 of the solenoid structure, inside of the coil 16.

The armature 32 is suitably directly coupled to the reset rod 30, and intermediate the knob 31 and armature 32 a conically tapered locking head 34 is provided on the reset rod for cooperation with a mechanical latching means, to be described. The spring-urged rigid disc element 35 is adjustably held at 36 at a desired location on the rod 30 and is opposed by a resilient washer 37 or bumper at the adjacent end wall of the housing. The disc element 35 and rod 30 are constantly urged toward the engine shut-down position shown in FIG. 2 by an expansible coil spring 38 having one end bearing on the disc element and its opposite end engaging the end wall of housing section 19.

The aforementioned mechanical latch means for the rod 30 through its enlarged head 34 comprises a fixed bracket 39 secured to the solenoid coil structure 16 including opposed upstanding plate portions. A pivoted trip element 40 is pivotally attached to bracket 39 by a pivot pin 41 near the center of the element 40, as view in FIG. 2. A parallel tripping and latch pin 42 is provided on trip element 40 in slightly offset relation to the pivot pin 41, FIGS. 2 and 3, so that in the latched or recessed position of the rod 30, the latch pin 42 will be slightly beyond dead center in relation to the pin 41 while opposing movement of locking head 34 under influence of spring 38.

To render the mechanical latch means effective in all installed positions of the device 12, regardless of gravity, and to render it relatively uneffected by vibrations, a flat plate element 43 is arranged at the inner end of solenoid casing 22 and loosely secured thereto by a screw 44 mounting a light hold-down spring 45 for the plate element 43, which is adjustable as to tension by means of the screw 44. An intermediate reduced width part 46 of plate element 43 extends closely between the sides of bracket 39 to prevent the plate element 43 from rotating on the axis of screw 44. The plate element is slotted centrally at 47 to allow clearance around reset rod 30 which passes through the slot movably.

The trip element 40 has a pair of arm extensions 48 lying immediately outside of bracket 39, and projecting under the adjacent end portion of flat plate element 43. The near dead center relationship of pins 42 and 41 in the latching position of the mechanism shown in FIG. 3 allows plate element 43 under influence of spring 45 to bear down on arm extensions 48 with a relatively powerful force in relation to the spring urged force of the locking head 34 against latch pin 42, tending to rotate trip element 40 counter-clockwise in FIG. 3 on the axis of pin 41. This powerful retaining or holding force through plate element 43 is due to the relatively long arms 48 extended from the pivot pin 41 and the very short opposing moment arm between slightly offset pins 41 and 42. As a result, the mechanical latch means described can resist heavy vibration and is capable of locking the rod 30 in the engine on position of FIG. 3 and FIG. 1 despite the outward pressure of spring 38 on the reset rod 30.

However, for the mechanical latching means to hold the device in the engine on or running position against the force of spring 38, the solenoid coil 16 must also be energized and pulling and holding the armature 32 inside of sleeve 32. In other words, it is the combined holding force of the energized solenoid and the described mechanical latching means which is necessary to retain the rod 30 in the latched position shown in FIG. 3 after the device is set or reset manually by pushing on the knob 31.

Figure 4:
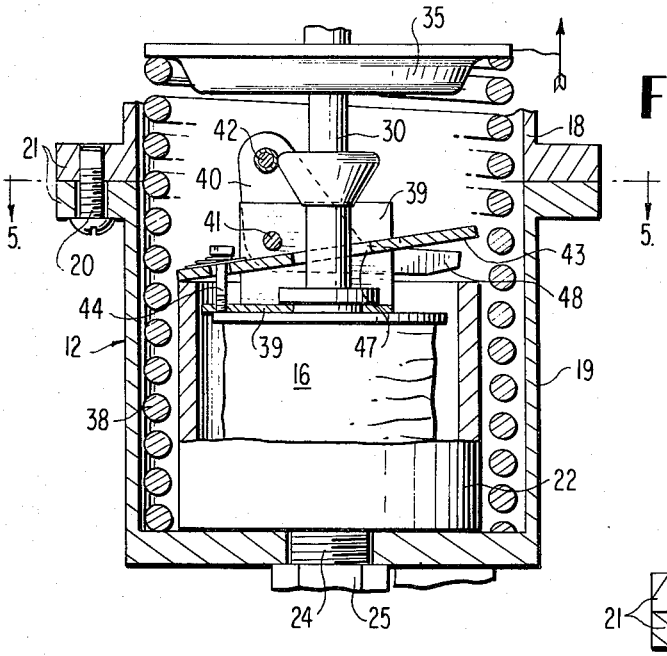
FIG. 4 is a further fragmentary central vertical sectional view depicting the latch mechanism at the moment of release or tripping responsive to an engine malfunction resulting in electrical power to the solenoid being interrupted by safety switches.
Figure 5:
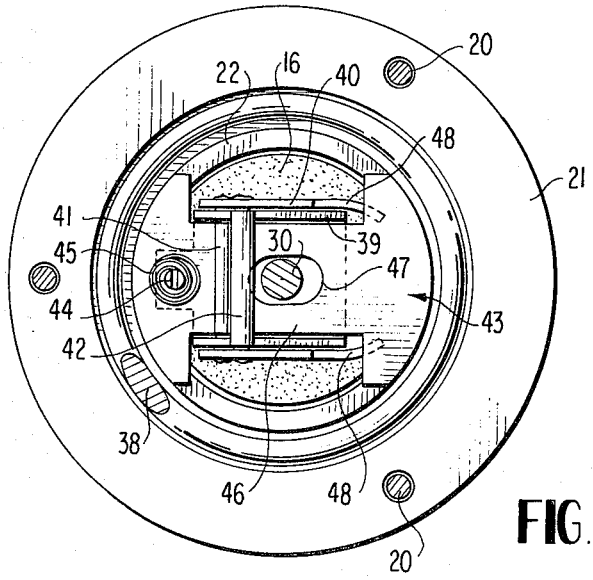
FIG. 5 is a horizontal section taken on line 5—5 of FIG. 4.

In every instance of engine malfunction causing opening of safety switches 17 by conventional means and resulting de-energizing of the solenoid coil 16, the force of spring 18 acting through locking head 34 and against trip pin 42 will trip or release the mechanical latch as depicted in FIG. 4 and the device will immediately spring to the engine shut-off position shown in FIG. 2 and will remain in this position until manually reset. The spring-loaded plate element 43 will have its holding force against arms 48 overcome by the force of spring 38 the instant following de-energizing of the solenoid. When the rod 30 moves outwardly from the housing, FIG. 2, until the disc 35 abuts bumper washer 37, the resulting movement of cable 26 will pull the engine rack 11 to the engine shut-off position.

Figure 3:
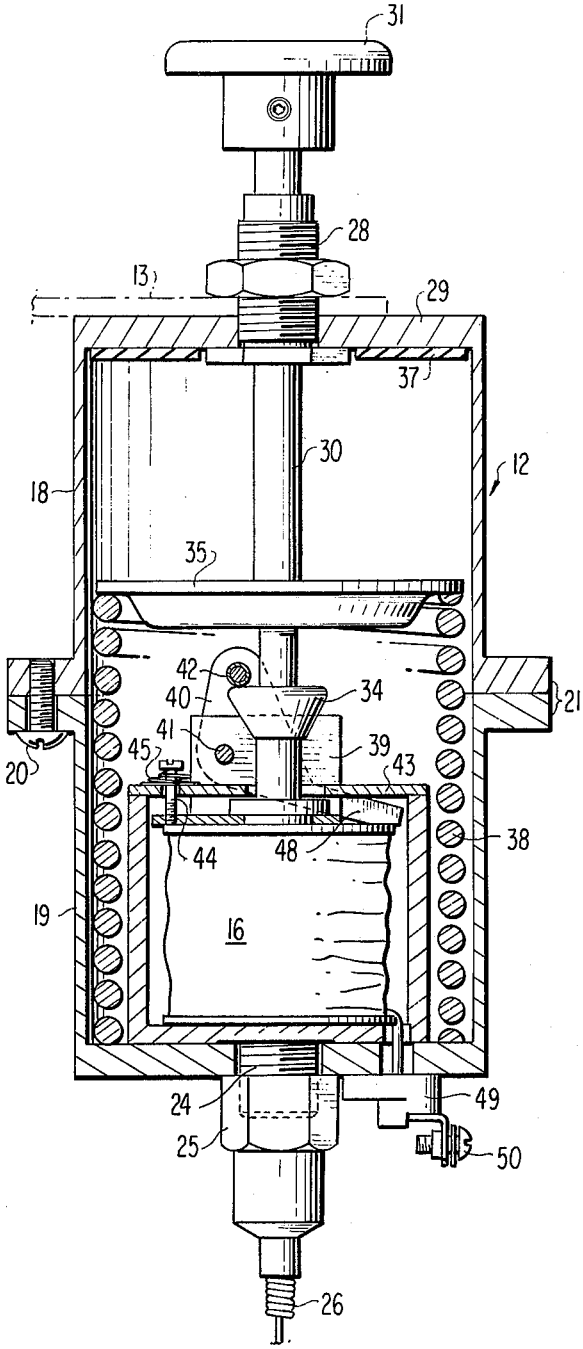
FIG. 3 is a similar view of the invention in the engine on or running position.

When the reset rod 30 is manually returned to the position of FIG. 3, the tapered head will ride over trip pin 42 and become latched behind this pin and if the solenoid is re-energized as by correction of the engine malfunction and re-establishment of the current supply, the device will remain in the engine on position. If the malfunction still exists, the latch mechanism will not hold and will be overcome by the spring 38 and the rack 11 will be pulled.

The terminals of solenoid coil 16 are connected with cable 15 externally of housing section 19 by a suitable terminal block 49 having terminal screws 50.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An engine shut-down device comprising a housing, a solenoid coil mounted within one end portion of the housing, a manual reset rod having guided engagement with the opposite end of the housing and projecting inside and outside of the housing axially, a solenoid armature directly carried by the reset rod in the housing and shiftable axially therewith and adapted to enter a bore portion of the solenoid coil when the reset rod is moved manually in one direction, a locking head element on the reset rod in the housing and intermediate the ends of the rod, an abutment disc on the reset rod in axially spaced relation to said head and adapted to contact the end of the housing remote from the solenoid coil to limit outward extension of the reset rod, a spring within the housing engaging the abutment disc and urging it constantly toward the last-named end of the housing, an actuator cable means extending beyond the end of the housing adjacent to the solenoid coil and attached to said reset rod and armature and moving therewith and adapted for connection with a shiftable fuel control rack of an engine, and a mechanical latching means for said locking head element of the reset rod moving into latching engagement with the head element whenever the reset rod is manually operated and the holding force of the mechanical latching means plus the holding force of the solenoid coil on said armature being sufficient to retain said reset rod latched in an engine on position, de-energizing of said coil responsive to an engine malfunction causing said mechanical latching means to be overcome by the force of said spring whereby the reset rod is shifted with said cable means to an engine shut-down position.

2. An engine shut-down device as defined by claim 1, wherein said mechanical latching means is secured to a body portion of the solenoid coil and includes pivoted trip and latching element in the path of movement of the locking head element, and a yielding means connected with the pivoted element and biasing it toward a locking position in relation to the locking head element.

3. The structure of claim 2, and said mechanical latching means further comprising a bracket fixed to said body portion, a pivot pin on said bracket, said pivoted trip and latching element rockably mounted on said pivot pin, a parallel trip and latching pin on the rockable element adapted to engage and ride over the head element when said manual reset rod is shifted toward an engine on position, said locking head element being tapered, and said trip and latching pin being in a near dead center relationship with said pivot pin after moving into locking engagement with the tapered locking head element.

4. The structure of claim 3, and said yielding means comprising a spring urged plate element on said body portion having engagement with a part of the pivoted trip and latching element and urging the latter toward locking engagement with said head element.

5. The structure of claim 4, and said pivoted trip and latching element having an arm extension projecting away from a common side of said pivot pin and said parallel trip and latching pin, and said spring urged plate bearing on said arm extension slidably.

6. An engine shut-down device as defined by claim 1, and said spring comprising an expansion coil spring in said housing having one end bearing on the end wall of the housing adjacent the solenoid coil and surrounding said coil.

7. An engine shut-down device as defined by claim 1, and said actuator cable means including an end coupling having screw-threads, and a mating threaded coupling part on said solenoid coil projecting outwardly of the adjacent end wall of the housing.

8. The structure of claim 7, and terminal means for said solenoid coil exteriorly of said housing on said end wall.

9. The structure of claim 8, and said housing comprising axially opposing separable housing sections dividing the housing near its longitudinal center.

10. An engine shut-down device as defined by claim 1, and a guide sleeve element for said manual reset rod on one end wall of the housing and having an adjustable element thereon in spaced relation to the end wall and adapted to secure the device to a support element.

* * * * *